US005111844A

United States Patent [19]

Emmert et al.

[11] Patent Number: 5,111,844

[45] Date of Patent: May 12, 1992

[54] AUTOMOTIVE FUEL SYSTEM

[75] Inventors: Dan H. Emmert, Grand Blanc; John E. Creager, Linden; Timothy F. Coha, Davison, all of Mich.

[73] Assignee: General Motors Corporation, Detroit, Mich.

[21] Appl. No.: 783,666

[22] Filed: Oct. 28, 1991

[51] Int. Cl.[5] ..... E03B 11/00

[52] U.S. Cl. ..... 137/567; 137/573; 137/574; 137/575; 137/576; 123/514

[58] Field of Search ..... 137/571, 573, 574, 575, 137/576, 567; 123/510, 512, 514

[56] References Cited

U.S. PATENT DOCUMENTS

| | | | |
|---|---|---|---|
| 3,010,509 | 11/1961 | Scherenberg | 137/567 |
| 4,546,750 | 10/1985 | Brunell et al. | 123/514 |
| 4,694,857 | 9/1987 | Harris | 137/574 |
| 4,865,522 | 9/1989 | Radermacher | 417/203 |
| 4,878,518 | 11/1989 | Tuckey | 137/448 |
| 4,928,657 | 8/1990 | Asselin | 137/576 |
| 4,974,570 | 12/1990 | Szwargulski et al. | 123/514 |
| 5,050,567 | 9/1991 | Suzuki | 137/576 |

*Primary Examiner*—A. Michael Chambers
*Attorney, Agent, or Firm*—Saul Schwartz

[57] ABSTRACT

An automotive fuel system including a reservoir having upper and lower chambers on opposite sides of a partition in the reservoir, a high pressure fuel pump having an inlet connected to the lower chamber, a low pressure fuel overage return pipe returning overage fuel directly to the lower chamber, and a low pressure pump transferring fuel from the tank directly to the upper chamber. A drain in the partition conducts gravity induced fuel flow from the upper chamber to the lower chamber at a rate equal to the difference between the rate at which the high pressure pump withdraws fuel from the lower chamber and the rate at which overage is returned to the lower chamber through the overage return pipe.

4 Claims, 1 Drawing Sheet

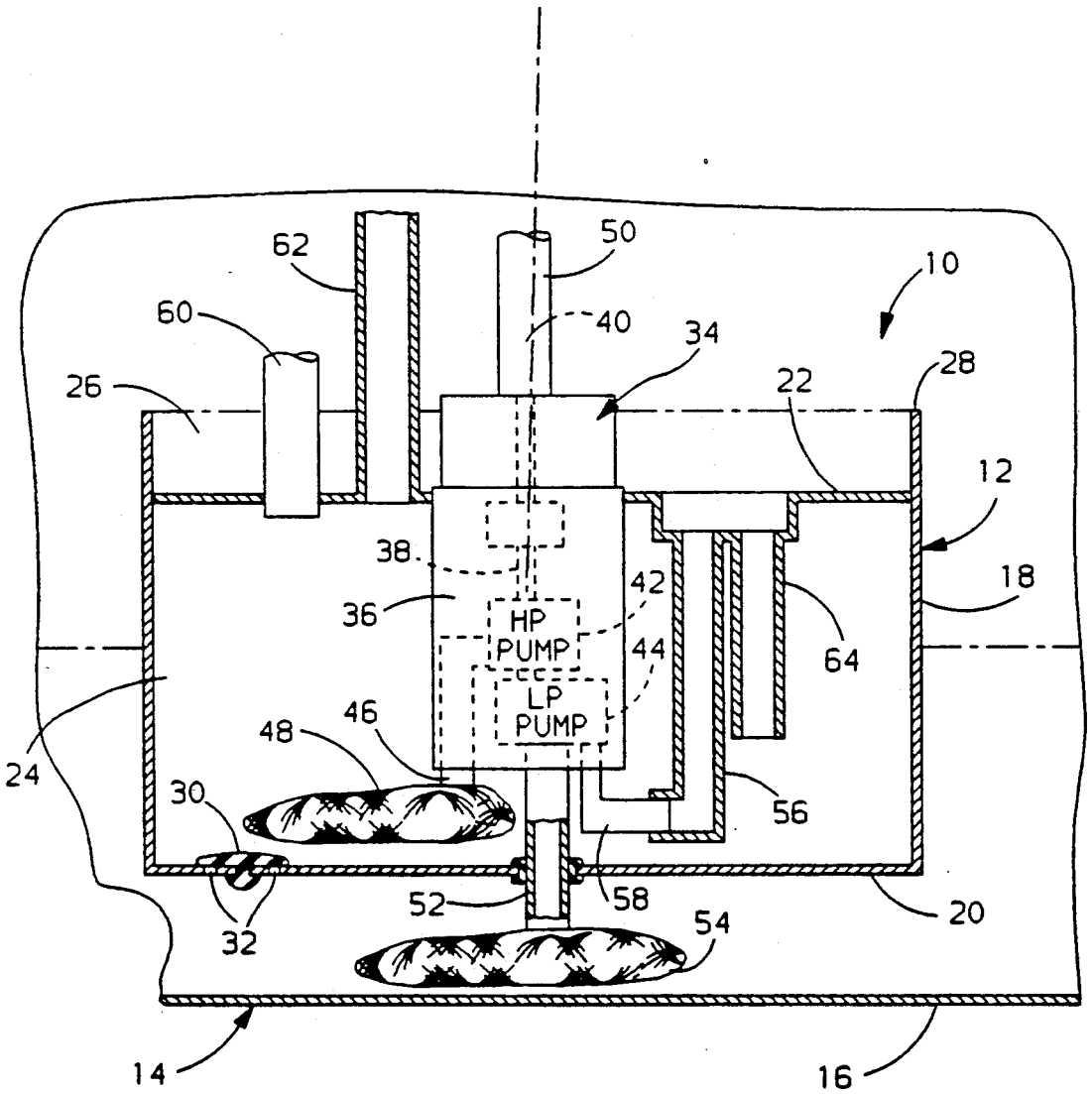
62
50
10
60
40
34
26
22
28
12
38
42
18
36
HP
PUMP
44
64
LP
PUMP
46
48
24
30
56
52
58
20
32
54
14
16

AUTOMOTIVE FUEL SYSTEM

FIELD OF THE INVENTION

This invention relates to automotive fuel systems.

BACKGROUND OF THE INVENTION

In modern automotive fuel injection systems, a fuel pump is mounted in a reservoir in a fuel tank and supplies fuel in excess of maximum engine demand. The surplus or overage is returned to the fuel tank. Proposals have been made to confine the overage to the reservoir to prevent mixing of the overage with bulk fuel and thereby remove a source of heating of the bulk fuel. For example, U.S. Pat. application Ser. No. 07/656,668, filed Feb. 15, 1991 and assigned to the assignee of this invention, describes a fuel system in which the reservoir is sealed and kept filled by a combination of overage and discharge of a low pressure jet pump. The jet pump recirculates reservoir overflow back into the reservoir in preference to bulk fuel from the fuel tank. U.S. Pat. No. 4,878,518 describes a fuel system in which a valve on a low pressure jet pump closes when the combination of jet pump discharge and overage exceeds the capacity of a sealed reservoir. U.S. Pat. No. 4,865,522 describes a fuel system in which a standpipe in a reservoir prevents escape of overage from the reservoir except when fuel in the reservoir overflows the standpipe. A fuel system according to this invention has a reservoir with a fuel pump therein and incorporates novel structure for supplying the fuel pump with overage in preference to bulk fuel.

SUMMARY OF THE INVENTION

This invention is a new and improved automotive fuel system including a partitioned reservoir having an upper chamber and a lower chamber. Overage is confined to the lower chamber and a fuel pump recirculates overage from the lower chamber back to the engine. In addition, the fuel system according to this invention has a low pressure pump which transfers fuel from the bulk fuel tank to the upper chamber of the reservoir. Overflow from the upper chamber returns to the bulk fuel tank. The partition in the reservoir has a drain which permits gravity induced fuel flow from the upper chamber to the lower chamber to make up the difference between the quantity of fuel removed from the lower chamber by the fuel pump and the quantity of overage returned to the lower chamber.

BRIEF DESCRIPTION OF THE DRAWING

The single drawing figure is a schematic illustration of a fuel system according to this invention.

DESCRIPTION OF PREFERRED EMBODIMENT

Referring to the drawing figure, an automotive fuel system (10) according to this invention includes a reservoir (12) in a bulk fuel tank (14) of a vehicle near a lower wall (16) of the tank. The reservoir includes a continuous side wall (18) closed on the bottom by a bottom wall (20). A partition (22) divides the reservoir into a lower chamber (24) between the bottom wall (20) and the partition (22) and an upper chamber (26) above the partition open to the bulk fuel tank over an upper edge (28) of the sidewall. A rubber or otherwise flexible umbrella valve (30) on the bottom wall (20) of the reservoir covers a plurality of orifices (32) in the bottom wall from inside the reservoir.

An electric fuel pump (34) as described in the U.S. Pat. application Ser. No. 07/657,695, filed Feb. 19, 1991 and assigned the assignee of this invention, is disposed in the reservoir (12) and includes a housing or shell (36) mounted in fluid sealed fashion on the partition (22). An electric motor in the shell (36) has a schematically represented armature shaft (38) rotatable about a vertical axis (40) of the reservoir. The armature shaft (38) is connected to the impellers, of a schematically illustrated high pressure fuel pump (42) and to the impeller of a similarly schematically illustrated low pressure pump (44).

An inlet or suction pipe (46) of the high pressure pump (42) is open directly to the lower chamber (24) of the reservoir through a filter screen (48). A discharge pipe (50) of the high pressure pump is connected to a fuel injection system of an engine, not shown, of the vehicle. An inlet or suction pipe (52) of the low pressure pump (44) is open directly to the bulk fuel tank (14) through a filter screen (54). A discharge pipe (56) connected to a discharge (58) of the low pressure pump opens directly into the upper chamber (26). The outside of the discharge pipe (56) is fluid sealed at the partition (22).

A return fuel pipe (60) conducts low pressure surplus or overage fuel from the engine of the vehicle back to the reservoir. The return fuel pipe discharges into the lower chamber (24). The outside of the return fuel pipe is sealed at the partition (22). The outside of a vapor vent pipe (62) is similarly sealed at the partition (22) and the pipe extends from the lower chamber (24) to the uppermost reach, not shown, of the bulk fuel tank above the maximum fuel level. A drain (64) in the partition (22) conducts gravity induced fuel flow from the upper chamber (26) to the lower chamber (24).

Overage returned to the lower chamber (24) is always less than the discharge of the high pressure pump (42). The discharge or flow rate of the low pressure pump (44) exceeds the discharge or flow rate of the high pressure pump. Under steady state conditions, then, fuel flows at varying rates by gravity through the drain (64) from the upper chamber to the lower chamber to make up the difference between the fuel removed from the lower chamber by the high pressure pump (42) and overage fuel returned to the lower chamber through the return pipe (60).

Excess or surplus from the low pressure pump (44) overflows or otherwise escapes from the upper chamber (26) into the bulk fuel tank. Since the low pressure pump, in effect, simply circulates bulk fuel within the bulk fuel tank, overflow or escape from the upper chamber does not contribute to heating of the bulk fuel in the tank.

In operation, the filter screen (54) may become momentarily exposed. For example, when the bulk fuel tank is almost empty and the vehicle turns a corner, fuel sloshing toward a side of the fuel tank may expose the screen. In that circumstance, flow from the low pressure pump (44) to the upper chamber (26) through the discharge pipe (56) is interrupted. Flow from the upper chamber (26) to the lower chamber (24), however, continues uninterrupted until the upper chamber (26) is emptied through the drain (64), which does not normally occur unless the tank (14) is empty. The screen (48) of the high pressure pump (42) remains submerged regardless of flow from the low pressure pump until both the upper and the lower chambers (26.24) are empty.

The orifices (32) in the bottom wall (20) of the reservoir facilitate engine restart after an out-of-fuel event in which the bulk fuel tank (14) and both the upper and lower chambers (26.24) are emptied. Normally, fuel does not flow through the orifices because pressure in the lower chamber equals or exceeds pressure outside the reservoir. After an out-of-fuel event, however, when filling may initially raise the outside fuel level above the inside level, outside pressure may exceed inside pressure. In that circumstance, the umbrella valve (30) may deflect and allow fuel directly into the lower chamber through the orifices (32) until the inside and outside levels equalize.

If the fuel pump (34) is turned on during refilling of the tank (14), the low pressure pump assists in filling the lower chamber by pumping fuel into the upper chamber (26) from which it flows by gravity into the lower chamber through the drain (64). If the level in the lower chamber exceeds the level outside the reservoir, the umbrella valve (30) closes to prevent backflow through the orifices (32).

We claim:

1. An automotive fuel system comprising:

a fuel tank, a high pressure discharge pipe between said tank and an engine for conducting high pressure fuel to said engine, a low pressure return pipe between said tank and said engine for conducting low pressure fuel overage to said tank, a reservoir in said fuel tank including a partition dividing said reservoir into an upper chamber and a lower chamber, means connecting said return pipe directly to said lower chamber so that said fuel overage is confined to said lower chamber, a high pressure fuel pump in said reservoir having an inlet connected to said lower chamber and a discharge connected to said high pressure discharge pipe so that said high pressure fuel pump transfers fuel from said lower chamber to said engine, a low pressure pump having an inlet open directly to said fuel tank and a discharge connected directly to said upper chamber so that said low pressure pump transfers fuel from said fuel tank directly to said upper chamber, means connecting said upper chamber to said fuel tank so that overflow from said upper chamber is to said fuel tank, and a drain between said upper chamber and said lower chamber conducting gravity induced fuel flow from said upper chamber into said lower chamber at a rate equal to the difference between the rate at which said high pressure pump transfers fuel from said lower chamber and the rate at which said return pipe transfers fuel overage into said lower chamber.

2. The fuel system recited in claim 1 and further including:

an orifice in a bottom wall of said lower chamber between said lower chamber and said fuel tank, and a check valve means on said bottom wall preventing fuel backflow out of said lower chamber when the fuel level in said lower chamber exceeds the fuel level in said fuel tank and permitting fuel flow directly into said lower chamber when the fuel level in said fuel tank exceeds the fuel level in said lower chamber.

3. The fuel system recited in claim 1 wherein said low pressure pump includes an impeller connected to said high pressure pump.

4. The fuel system recited in claim 1 and further including:

a vapor vent from said lower chamber to generally an uppermost reach of said fuel tank above the maximum fuel level in said fuel tank.

* * * * *